US006786444B2

(12) United States Patent
Tomura

(10) Patent No.: US 6,786,444 B2
(45) Date of Patent: Sep. 7, 2004

(54) WEB WINDING METHOD AND APPARATUS AND CONTACT ROLLER THEREOF

(75) Inventor: Seiji Tomura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 15 days.

(21) Appl. No.: 10/100,987

(22) Filed: Mar. 20, 2002

(65) Prior Publication Data

US 2002/0134880 A1 Sep. 26, 2002

(30) Foreign Application Priority Data

Mar. 21, 2001 (JP) ..... 2001-080743
Mar. 23, 2001 (JP) ..... 2001-085284
Jun. 8, 2001 (JP) ..... 2001-174175

(51) Int. Cl.[7] ..... B65M 18/26

(52) U.S. Cl. ..... 242/547; 242/541.5; 242/542.4; 242/115.4; 492/28; 492/37

(58) Field of Search ..... 242/547, 541.5–541.6, 242/542.4, 615.4; 492/28, 37

(56) References Cited

U.S. PATENT DOCUMENTS 3,405,855 A * 10/1968 Daly et al. ..... 242/615.4
3,851,832 A * 12/1974 Krueckels et al. ..... 242/541.6
4,189,815 A * 2/1980 Seelenbinder ..... 226/193
4,697,755 A * 10/1987 Kataoka ..... 242/534
5,026,005 A * 6/1991 Ehrola ..... 242/541.5
5,267,008 A * 11/1993 Rebres et al. ..... 399/388
5,335,871 A * 8/1994 Fissmann et al. ..... 242/595.1
5,370,327 A * 12/1994 Adamski ..... 242/533.1
5,456,946 A * 10/1995 Snellman ..... 427/222
5,546,173 A * 8/1996 Hinotani et al. ..... 399/331
5,836,860 A * 11/1998 Watanabe et al. ..... 492/56
5,967,450 A * 10/1999 May et al. ..... 242/547
6,234,419 B1 * 5/2001 Hehner et al. ..... 242/530.4

* cited by examiner

*Primary Examiner*—Kathy Matecki
*Assistant Examiner*—Sang Kim
(74) *Attorney, Agent, or Firm*—Sughrue Mion, PLLC

(57) ABSTRACT

A web winding method for wrapping a web comprising steps of: feeding the web having a thickness of 5 to 70 $\mu$m at a speed of 200 to 1000 m/min; wrapping the web around a contact roller of which a coefficient of friction at each axial end surface is lower than that at an axial center surface at a wrap angle of 45 to 180°; pressing the web against an outer peripheral surface of a web roll by the contact roller; and taking up the web in a rolled manner. Then, the web winding method can conspicuously prevent occurrence of flaws or wrinkles in a web without involvement of a drop in productivity.

6 Claims, 4 Drawing Sheets

WEB WINDING METHOD AND APPARATUS AND CONTACT ROLLER THEREOF

BACKGROUND OF THE INVENTION

The present invention relates to a web winding method for taking up a web such as a magnetic recording medium.

In a production line for manufacturing a magnetic recording medium, a non-magnetic support web is transported at a predetermined speed, and such as a magnetic layer is applied over the support web, and the magnetic layer is then dried. In some cases, a magnetic layer is evaporated onto the support web. Subsequently, the web coated with the magnetic layer is subjected to calendering.

A web winding apparatus is disposed in predetermined locations along the production line. The web winding apparatus winds the web in a rolled manner, and thus forms a web roll. For example, the web winding apparatus is disposed downstream of an apparatus for the calendering.

As shown in FIG. 6, in this web winding apparatus, a web 81 is fed, then a contact roller 70 gently presses the web 81 onto an outer peripheral surface of a web roll 80. By means of such a configuration, since air is not involved between the web 81 and the outer peripheral surface of the web roll 80, the web roll 80 forms a good shape.

In the example shown in FIG. 6, the contact roller 70 remains in a line contact with the web 81. Namely, a wrap angle of the web 81 makes close to 0° with respect to the contact roller 70. Such as a rubber roller having an elastic surface is employed as the contact roller 70.

The contact roller 70 has to remain in a line contact with the web 81, however the contact roller 70 is deformed by contact pressure that presses the web 81 against the outer peripheral surface of a web roll 80. Namely, when the web 81 twines around the contact roller 70 (at a certain wrap angle), the web 81 is slightly susceptible to the influence of the deformation of the contact roller 70, as a result of that flaws or wrinkles arise in the surface of the web 81.

Therefore, in order to maintain the line contact, a layout of an idle roller etc. to be disposed at upstream of the contact roller 70 has to be considered, and a design of facilities is regulated.

An increase in the feeding speed of a web (e.g., 200 m/min or more) is recently needed. In this light, a certain wrap angle of the web with respect to the contact roller prevents occurrence of meandering of the web (which becomes noticeable at higher speed). Hence, there has been a desire for establishment of facility design and process condition, which leaves a condition of "line contact" off.

SUMMARY OF THE INVENTION

It is an object of the present invention to provide a web winding method, a web winding apparatus and a contact roller, which can conspicuously prevent occurrence of flaws or wrinkles in a web without involvement of a drop in productivity.

The present invention provides a web winding method comprising steps of: feeding a web having a thickness of 5 to 70 $\mu$m at a speed of 200 to 1000 m/min; wrapping the web around a contact roller at a wrap angle of 45 to 180°, wherein a coefficient of friction of the contact roller at each axial end surface is lower than that at an axial center surface; pressing the web against an outer peripheral surface of a web roll by the contact roller; and taking up the web in a rolled manner.

Further, the present invention provides a web winding apparatus for wrapping a web which has a thickness of 5 to 70 $\mu$m and is fed at a speed of 200 to 1000 m/min in a rolled manner, and producing a web roll therefrom, comprising: a contact roller for pressing the web against an outer peripheral surface of the web roll, having both end surfaces and a center surface therebetween in its axial direction, wherein each end surface has a coefficient of friction lower than that of the axial center surface; and a guide path for wrapping the web around the contact roller at a wrap angle of 45 to 180°.

The present invention may also provide a contact roller for pressing a web against an outer peripheral surface of a web roll, having both end surfaces and a center surface therebetween in its axial direction, wherein each end surface has a coefficient of friction lower than that of the axial center surface.

The problem can also be solved by a web winding method comprising steps of: feeding a web having a thickness of 5 to 70 $\mu$m at a speed of 200 to 1000 m/min; wrapping the web around a contact roller at a wrap angle of 45 to 180°, having an inner layer and an outer layer, wherein hardness of the outer layer is greater than that of the inner layer; pressing the web against an outer peripheral surface of a web roll by the contact roller; and taking up the web in a rolled manner.

The problem can also be solved by a web winding apparatus for wrapping a web which has a thickness of 5 to 70 $\mu$m and is fed at a speed of 200 to 1000 m/min in a rolled manner, and producing a web roll therefrom, comprising: a contact roller for pressing the web against an outer peripheral surface of the web roll, having an inner layer and an outer layer, wherein hardness of the outer layer is greater than that of the inner layer; and a guide path for wrapping the web around the contact roller at a wrap angle of 45 to 180°.

The problem can also be solved by a contact roller for pressing a web against an outer peripheral surface of a web roll, having an inner layer and an outer layer, wherein hardness of the outer layer is greater than that of the inner layer.

As the result of that the present inventors devoted themselves to consider, they found that, by disposing a coefficient of friction of the axial center surface of the contact roller, lower than that of the axial end surface thereof, a web was less susceptible to an adverse effect such as occurrence of flaws. Namely, even when the above-mentioned case that a contact roller has been deformed by the contact pressure, deformation of the web has been absorbed to each axial end of the web over a contact roller. Hence, even if the web is wrapped around the contact roller in a high feeding speed, the web is less susceptible to an adverse effect such as occurrence of flaws.

In this case, it is preferable that a contact roller has the maximum coefficient of friction at the axial center portion thereof, and the coefficient of friction is gradually decreased from the axial center to axial ends thereof. However, the present invention is not limited to such a structure. For example, the coefficient of friction of a roller surface may be changed in an axial direction of the roller in phase.

On the other hand, if the contact roller is formed of a double-layer structure having different degrees of hardness of materials, the contact roller deforms uniformly, so as to well respond to the web. Namely, even when the above-mentioned case that a contact roller is deformed by the contact pressure, deformation of the web is absorbed. Hence, even if the web is wrapped around the contact roller, in a high feeding speed, the web is less susceptible to an adverse effect such as occurrence of flaws.

In this case, there is no limitation particularly to an outer dimension of the contact roller and to dimensions of the inner and outer layers of the contact roller. However it is preferable to produce a relative difference of hardness between the inner and outer rubber layers, and to set the whole hardness of the rubber layers to a rubber hardness (HsA) of, e.g., about 35. Here, the rubber hardness is defined in that the hardness (HsA) is measured by the spring type hardness test (A type) defined in JIS (Japanese Industrial Standard).

Namely, it is preferable to set the outer rubber layer to a rubber hardness (HsA) of, e.g., about 40, which is a well known and common requirement. In addition, it is preferable to set the inner rubber layer to a rubber hardness (HsA) of about 20.

As a result of a further study by the present inventors, a superior result was obtained in the case of a so-called thin web having a thickness of 70 $\mu$m or less by means of each of the methods.

This is the reason why the thin web has low rigidity, and the web can readily follow the deformation of the contact roller within the range of elasticity.

The reason of such a phenomenon is not definite. However, the phenomenon is noticeable in the range of feeding speed e.g., 20 m/min or higher, which has not been achieved conventionally.

Probably, the phenomenon is considered to be ascribable to the influence of behavior of involved air. A hydrodynamic approach to solve the phenomenon is still intensively underway.

In any event, as experimental facts, an improvement in a wrap angle, which has not been achieved conventionally can be achieved under a condition that:

(1) a web having a thickness of 70 $\mu$m or less is wrapped at a speed of 200 m/min or more, and by means of (2) setting the coefficient of friction of axial end surfaces of the contact roller lower than that of the axial center surface of the contact roller.

In addition, an improvement in a wrap angle, which has not been achieved conventionally, can also be achieved under a condition that:

(1) a web having a thickness of 70 $\mu$m or less is wrapped at a speed of 200 m/min or more and by means of (2) forming a contact roller so as to be a double-layer structure.

In addition, in each of the above two structures, general repeated tests are intensively performed under conditions, as follows; a winding speed is limited to the highest speed of 1000 m/min which can be effected stably under an industry-scale test; a web thickness is limited to a thickness of 5 $\mu$m which is the lowest limit for an industry product and a wrap angle is limited to a range of 45 to 180 ° in the range of which the flexibility of equipment design can be ensured.

DETAILED DESCRIPTION OF THE PREFERRED EMBODIMENTS

A first embodiment of the present invention will be described hereunder, by reference to the accompanying drawings.

Figure 1:
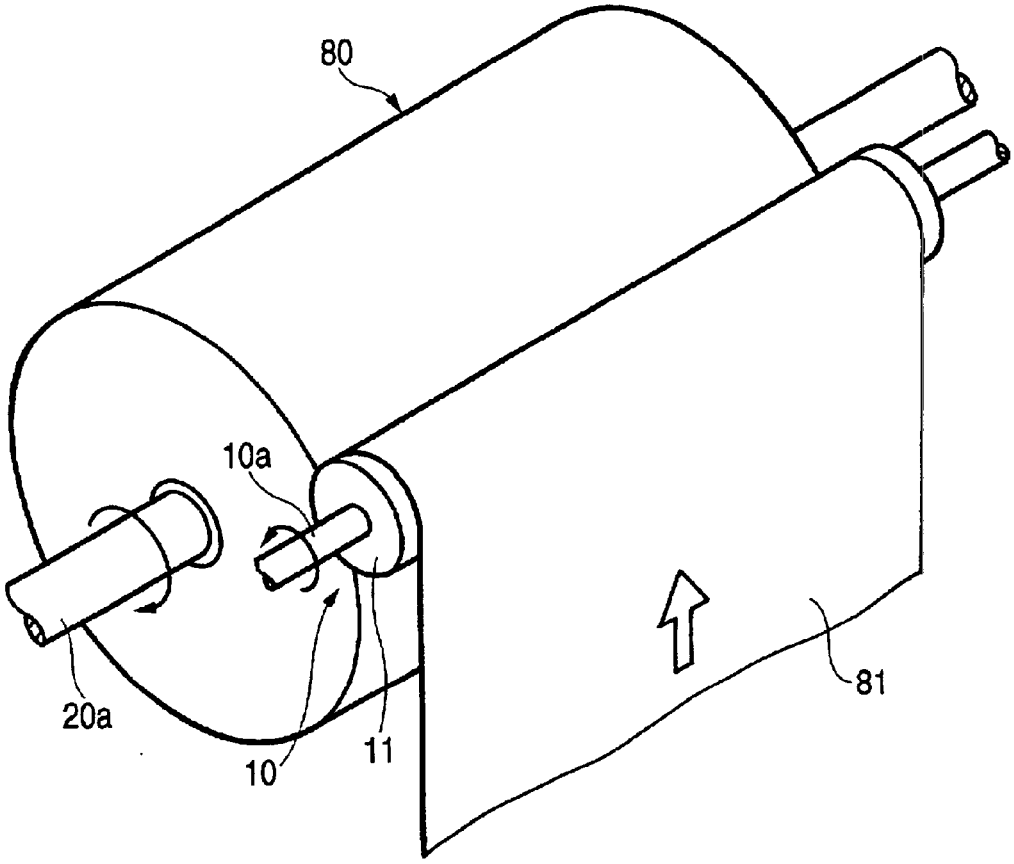
FIG. 1 is a schematic perspective view showing a first embodiment of the present invention.

FIG. 1 shows the relevant part of a web winding apparatus to be disposed in a production line for manufacturing a magnetic recording medium according to a first embodiment of the present invention. The web winding apparatus is disposed downstream of a calendering apparatus.

A rubber layer 11 is provided around a rotary shaft 10*a* of a contact roller 10. The width of the rubber layer 11 is slightly wider than that of a web 81 (in an axial direction thereof).

A winding shaft 20*a* of a web roller 80 is rotated by unillustrated rotary drive means.

The rotary shaft 10*a* of the contact roller 10 is rotated by means of unillustrated rotary drive means in the direction opposite to a rotating direction of the web roller 80. Further, the rotary shaft 10*a* is pressed against an outer peripheral surface of the web roller 80 by a pressing mechanism (not shown).

The winding operation of the web winding apparatus having the foregoing structure will now be described. A web 81 has a thickness of 10 to 30 $\mu$m and has been transported from a lower position toward a higher position at a speed of 250 to 300 m/min. The web 81 is wrapped around the contact roller 10 at a wrap angle of 45 to 180°. The contact roller 10 rotates at a speed comparable with the feeding speed of the web 81, and guides the web 81 toward the web roller 80 while changing of direction of the web 81 along a U-turn path. Before the web 81 departs from the contact roller 10, the web 81 is gently pressed against an outer peripheral surface of the web roller 80 by the contact roller 10. At this time, the winding shaft 20*a* of the web roller 80 rotates at a speed comparable with the feeding speed of the web 81. Thus, the winding shaft 20*a* continuously winds the web 81.

Conventionally, flaws or wrinkles would arise when the web 81 is wrapped around the contact roller 10 at a deep wrap angle. However, in this embodiment, the coefficients of friction of respective axial end surfaces of the contact roller 10 are smaller than that of the center surface of thereof. As a result, even if the contact roller 10 is deformed by contact pressure, deformation of the web 81 is absorbed to the respective axial ends thereof over the contact roller 10. Hence, even when the web 81 is wrapped around the contact roller 10 at high speed (at a speed of 200 m/min or more), the web 81 is protected from an adverse effect of such as occurrence of flaws.

Figure 2:
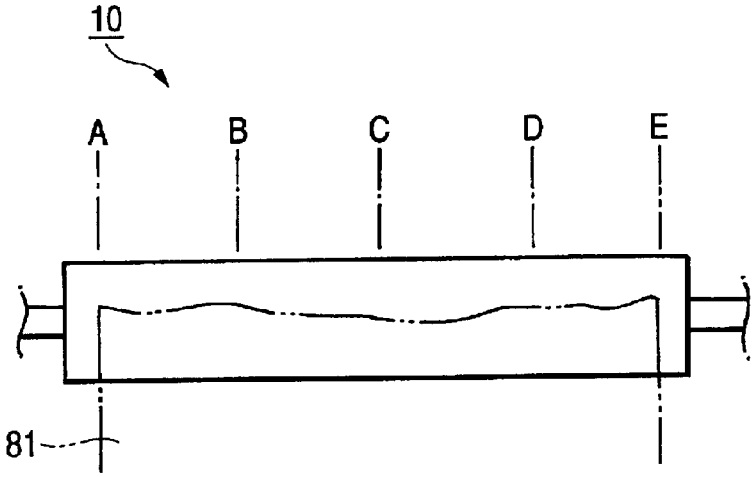
FIG. 2 is a plan view showing a contact roller according to the first embodiment.

As shown in FIG. 2, the surface of an axial center portion C of the contact roller 10 has the highest coefficient of friction. On the other hand, the surfaces of axial ends A, E of the contact roller 10 (with which both sides of the web 81 contact in the width direction) have the lowest coefficient of friction. The coefficient of friction of a surface of an intermediate point B between the end A and the center portion C is lower than that of the center portion C and higher than that of the ends A, E. Similarly, the coefficient of friction of a surface of an intermediate point D between the end E and the center portion C is lower than that of the center portion C and higher than that of the ends A, E.

Figure 3:
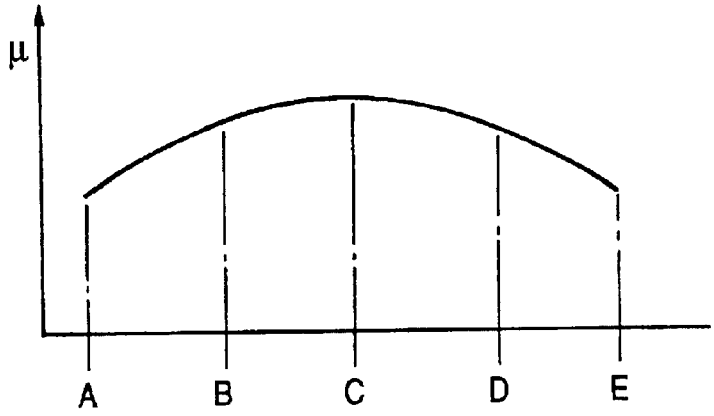
FIG. 3 is a graph showing a surface coefficient of friction of the contact roller shown in FIG. 2.

FIG. 3 is a graph, wherein the vertical axis shows a coefficient of friction $\mu$ and the horizontal axis shows an axial position of the roller 10. As shown in FIG. 3, the coefficient of friction $\mu$ shows a quadratic curve whose peak (maximum value) appears in the axial center portion C of the roller 10. More specifically, the coefficient of friction $\mu$ gradually decreases from the axial center portion C toward the axial ends A, E.

Specific coefficients of friction vary according to the nature of an object. For example, a coefficient of friction of the axial center portion C can be set about 0.5; that of the intermediate points B, D can be set about 0.3; and that of the axial ends A, E can be set about 0.2.

As mentioned above, it is preferable that a contact roller 10 has the maximum coefficient of friction at the axial center portion C thereof and the coefficient of friction gradually decreases from the axial center to the each axial end. However, the coefficient of friction may be changed in phase.

Figure 4A:
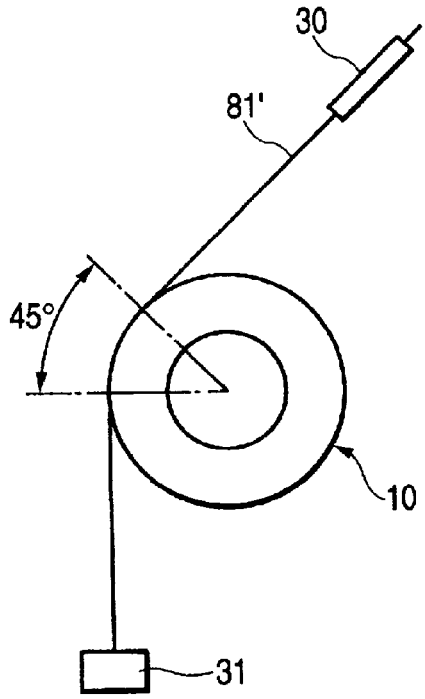
FIGS. 4A and 4B are illustrations for describing a method of measuring a coefficient of friction.

The coefficient of friction $\mu$ of the surface of the contact roller 10 can be measured by, for example, a measuring method shown in FIG. 4A. Measuring means 30, such as a spring scale or push-pull gauge, is connected to one end of a tape 81' of predetermined length. A weight 31 (e.g. 50 g) is suspended at the other end of the tape 81'. The tape end is pulled vertically downward by means of given force (e.g., about 0.5 N). The tape 81' disposed between the measuring means 30 and the weight 31 is wrapped around a predetermined axial position on the contact roller 10 having predetermined outside diameter (e.g., 125 mm) at a predetermined angle (e.g., 45°). By reading indications on the measuring means 30, the coefficient of friction $\mu$ of the surface of the contact roller 10 in the predetermined axial direction is determined.

Figure 4B:
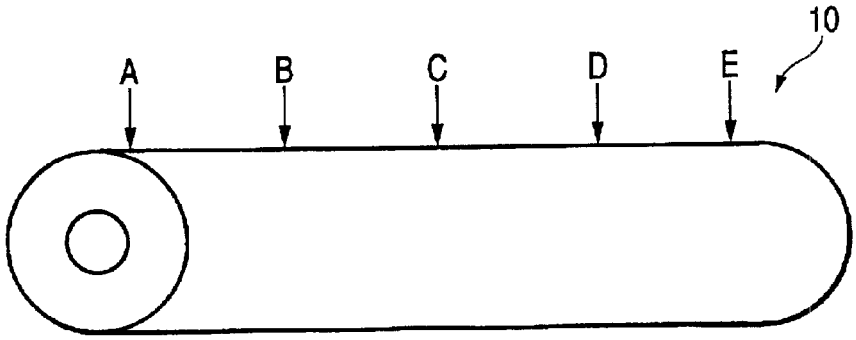

As shown in FIG. 4B, static coefficients of friction $\mu$ can be determined in five locations A through E on the contact roller 10 which are axially spaced away from each other at a predetermined interval (e.g., an interval of 240 mm). The ends A, E can be spaced a predetermined interval (of, e.g., 50 mm) from the respective axial ends of the contact roller 10 toward the axial center. Indications of the measuring means 30 show, e.g., about 15 to 20N. The indication of the measuring means 30 at the axial center point C is greater than those at points B and D. In contrast, the indications of the measuring means 30 at points B and D are greater than those at points A and E.

Measurement of coefficients of friction is to be effected under humidity of, e.g., 50 to 60% RH.

There will now be described a second embodiment in which a contact roller has a double-layer structure.

Figure 5:
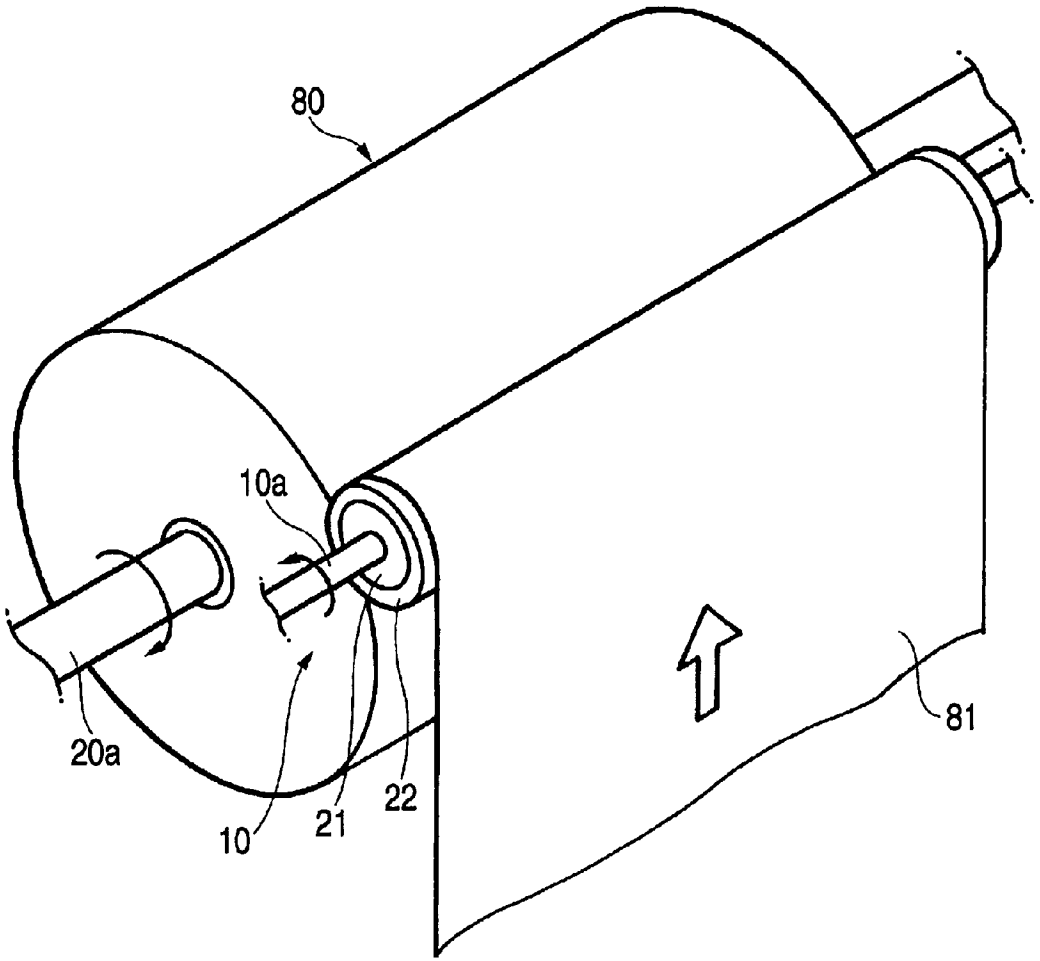
FIG. 5 is a schematic perspective view showing a second embodiment of the present invention.
Figure 6:
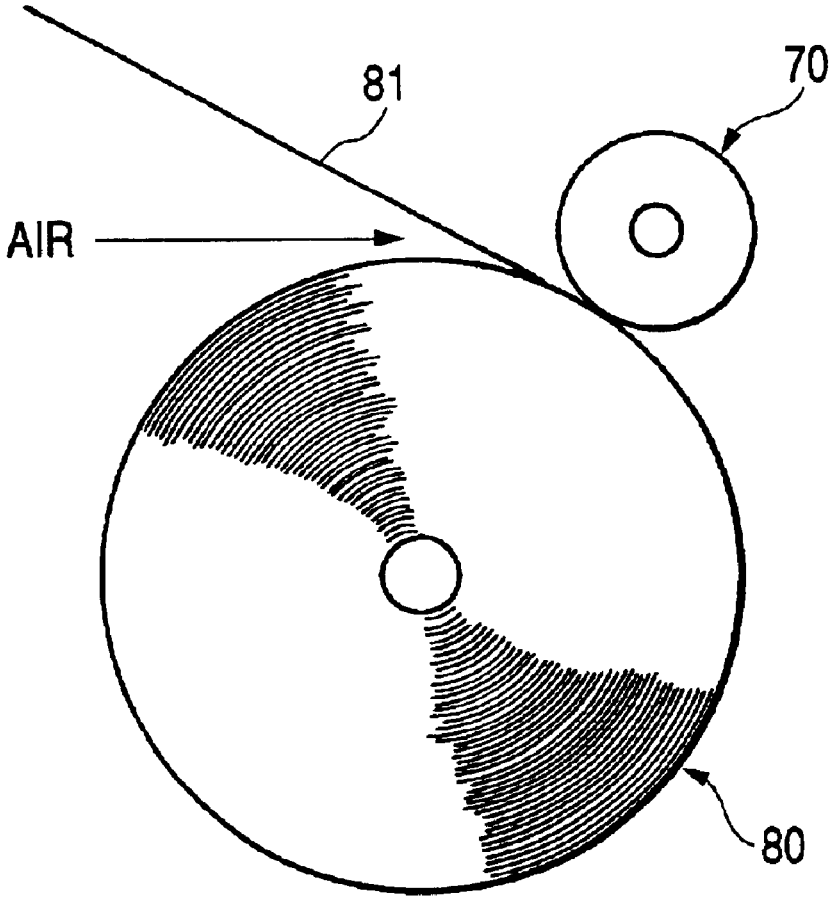
FIG. 6 is a conceptual rendering of a related-art web winding apparatus.

FIG. 5 shows the relevant part of a web winding apparatus disposed in a production line for manufacturing a magnetic recording medium. The web winding apparatus is to be disposed downstream of a calendering apparatus.

A first rubber layer 21 is provided around the rotary shaft 10*a* of the contact roller 10, and a second rubber layer 22 is provided on the exterior of the first rubber layer 21. The second rubber layer 22 is harder than the first rubber layer 21. The width of the second rubber layer 22 is slightly wider than that of the web 81 (in the axial direction thereof).

To be more precise, the outer rubber layer, for example, has a rubber hardness (HsA) of, e.g., about 40, and the inner rubber layer has a rubber hardness (HsA) of about 20. Thus, there is a relative difference in hardness between the outer rubber layer and the inner rubber layer. The hardness of the rubber layers is wholly disposed to a rubber hardness (HsA) of, e.g., about 35.

In other respects, another structure of the web winding apparatus is same as that of the first embodiment, and hence its explanation is omitted.

As mentioned above, the contact roller 10 is formed so as to be a multilayer structure (e.g., a double-layer structure) formed from materials having different degrees of hardness. As a result, the contact roller 10 can be deformed uniformly, thus well responding to the web 81. Even when the contact roller 10 is deformed by contact pressure, deformation of the contact roller 10 is absorbed by the multilayer structure. Even if the web 81 is wrapped around the contact roller 10 at high speed (e.g., 200 m/min or more), the web 81 is protected from an adverse effect such as the occurrence of flaws or wrinkles.

Even in the present embodiment, there can be produced an excellent web roll 80 having less web wrinkles or flaws.

The present invention is not limited to the previous embodiments and may be susceptible to various modifications or improvements.

For example, the web 81 may be wrapped around the contact roller 10 at a wrap angle of higher than 180°.

The coefficients of friction of axial end surfaces of the contact roller may be lower than that of the axial center surface. Further, a plurality of layers may be provided around the rotary shaft. For example, inner and outer layers may be provided around the rotary shaft, and the hardness of the outer layer may be greater than that of the inner layer. Thus, the present invention may be embodied by combination of the first and second embodiments.

The contact roller is not limited to the production line for manufacturing a magnetic recording medium but may be applied to a production line for manufacturing a photographic film or another strip-shaped material.

As has been described, the present invention can provide a web winding method which can conspicuously prevent occurrence of flaws or wrinkles in a web without involvement of a drop in productivity.

What is claimed is:

1. A web winding method comprising steps of:

feeding a web having a thickness of 5 to 70 $\mu$m at a speed of 200 to 1000 m/min;

wrapping the web around a grooveless contact roller at a wrap angle of 45 to 180°, wherein a friction coefficient distributed along the axial length of the contact roller follows a quadratic curve, the friction coefficient of the contact roller at each axial end surface being lower than that at an axial center surface;

pressing the web against an outer peripheral surface of a web roll by the contact roller; and taking up the web in a rolled manner.

2. A web winding apparatus for wrapping a web which has a thickness of 5 to 70 $\mu$m and is fed at a speed of 200 to 1000 m/min in a rolled manner, and producing a web roll therefrom, comprising:

a grooveless contact roller for pressing the web against an outer peripheral surface of the web roll, having both end surfaces and a center surface therebetween in its axial direction, wherein a friction coefficient distributed along the axial length of the contact roller follows a quadratic curve, each end surface having a friction coefficient lower than that of the axial center surface; and a guide path for wrapping the web around the contact roller at a wrap angle of 45 to 180°.

3. A grooveless contact roller for pressing a web against an outer peripheral surface of a web roll, having both end surfaces and a center surface therebetween in its axial direction, wherein a friction coefficient distributed along the axial length of the contact roller follows a quadratic curve, and each end surface having a friction coefficient lower than that of the axial center surface.

4. A web winding method comprising steps of:

feeding a web having a thickness of 5 to 70 $\mu$m at a speed of 200 to 1000 m/min;

wrapping the web around a grooveless contact roller at a wrap angle of 45 to 180°, having an inner layer and an outer layer, wherein a friction coefficient distributed along the axial length of the contact roller follows a quadratic curve, each end surface having a friction coefficient lower than that of the axial center surface and a hardness of the outer layer is greater than that of the inner layer;

pressing the web against an outer peripheral surface of a web roll by the contact roller; and taking up the web in a rolled manner.

5. A web winding apparatus for wrapping a web which has a thickness of 5 to 70 $\mu$m and is fed at a speed of 200 to 1000 m/min in a rolled manner, and producing a web roll therefrom, comprising:

a grooveless contact roller for pressing the web against an outer peripheral surface of the web roll, having an inner layer and an outer layer, wherein a friction coefficient distributed along the axial length of the contact roller follows a guadratic curve, each end surface having a friction coefficient lower than that of the axial center surface and a hardness of the outer layer is greater than that of the inner layer; and a guide path for wrapping the web around the contact roller at a wrap angle of 45 to 180°.

6. A grooveless contact roller for pressing a web against an outer peripheral surface of a web roll, having both end surfaces and a center surface therebetween in its axial direction, wherein a friction coefficient distributed along the axial length of the contact roller follows a quadratic curve, each end surface having a friction coefficient lower than that of the axial center surface, and the contact roller having an inner layer and an outer layer, wherein a hardness of the outer layer is greater than that of the inner layer.

* * * * *